US005611163A

United States Patent [19]

Smith

[11] Patent Number: 5,611,163

[45] Date of Patent: Mar. 18, 1997

[54] DIRECTION INDICATOR COVERS FOR EMERGENCY LIGHTING SYSTEMS

[75] Inventor: Stephen T. Smith, Conyers, Ga.

[73] Assignee: National Service Industries, Inc., Atlanta, Ga.

[21] Appl. No.: 327,487

[22] Filed: Oct. 21, 1994

[51] Int. Cl.[6] ..... G09F 13/04

[52] U.S. Cl. ..... 40/570; 40/580; 403/13

[58] Field of Search ..... 40/570, 580, 583; 403/13, 326, 345, 360; 220/284, 307; 362/456

[56] References Cited

U.S. PATENT DOCUMENTS

| | | |
|---|---|---|
| 3,402,494 | 9/1968 | Gray . |
| 3,445,030 | 3/1968 | Lutzker . |
| 3,478,455 | 11/1969 | Fremont . |
| 3,620,403 | 11/1971 | Rump . |
| 3,665,626 | 5/1972 | Lund et al. . |
| 3,931,689 | 1/1976 | Shine . |
| 4,103,804 | 8/1978 | Fournier et al. . |
| 4,258,487 | 3/1981 | Hohorst . |
| 4,355,479 | 10/1982 | Thornton . |
| 4,458,825 | 7/1984 | Holota . |
| 4,561,203 | 12/1985 | MacDonald, Jr. et al. . |
| 4,784,285 | 11/1988 | Patel . |
| 4,889,380 | 12/1989 | Pillifant, Jr. . |
| 4,905,861 | 3/1990 | Boxall et al. . |
| 4,934,554 | 6/1990 | Edwards . |
| 5,018,290 | 5/1991 | Kozek et al. . |
| 5,069,357 | 12/1991 | Anderson . |
| 5,247,756 | 9/1993 | Johnstone . |
| 5,272,605 | 12/1993 | Johnstone . |
| 5,428,912 | 7/1995 | Grondal et al. ..... 40/570 |

OTHER PUBLICATIONS

Brochure, "Kast Exits—Stencil or Plastic Face," Incandescent Catalog, Lithonia Lighting, Inc. p. 26 (1965).

Brochure, "Fail–Safe Exit Sign," Lithonia Lighting (1971).

Brochure, "Exit Series—Plastic Face," Lithonia Lighting, p. 64, (1971).

Brochure, "ES/EP Premium Exits," Lithonia, p. 52 (1980).

Brochure, "AS/AP Incandescent Series," Lithonia Emergency Lighting, (1984).

Installation Instructions, "Spectrum Series Model MS/MP 120/277 Exit Signs," Lithonia Emergency Systems (Jul. 28, 1986).

Brochure, "Open the Door to a Spectrum™ of Opportunity," Lithonia Emergency Systems, (1987).

Brochure, "Spectrum Series—Contemporary Injection Molded Emergency Exit Signs," Lithonia Emergency Systems (1987).

(List continued on next page.)

*Primary Examiner*—Brian K. Green

*Attorney, Agent, or Firm*—Kilpatrick & Cody, L.L.P.

[57] ABSTRACT

Detachable chevron-shaped panels that fit within chevron-shaped apertures in the cover of an exit sign. The panels are dimensioned to fit integrally into the apertures in order to withstand years of stress, temperature changes, and wear and tear but continue to perform in a light-fast and reliable manner. Yet they may be easily installed from the exterior of the exit sign, with minimum risk that they will fall into the interior during installation. Surprisingly, the present devices permit such easy installation without the need to use conventional "slide 'n' snap" exit sign arrow fasteners that usually allow reliable installation but have proven to be destructive of a secure fit and light fastness. The panel accomplishes this by employing at least three tabs positioned in a certain manner about the perimeter of each wing of the panel which engage the (preferably bevelled) edge of the chevron-shaped aperture. The tabs are disposed in various quadrants around the centroid of each wing of the panel in order to create an integral fit of the long chevron wings to the cover and thus to reduce inadvertent detachment of the whole panel if a part of it is dislodged, or if the cover is deformed through heat or physical stress. Such positioning also provides multiple retention axes between tabs and creates lateral forces and bending moments, should any tab become dislodged, in order to continue securing the wing and the panel in place.

22 Claims, 4 Drawing Sheets

OTHER PUBLICATIONS

Brochure, "Spectrum Series—Emergency Exit," Lithonia Emergency Systems (1987).
Brochure, "Introducing the Quantum Difference," Lithonia Emergency Systems (1989).
Brochure, "Introducing The New QM–EL Quantum Emergency Exit Sign," Lithonia Lighting (1992).
Brochure, "Your Choice of Exit Signs Can Make a World of Difference," Lithonia Lighting (1993).
Installation Instructions and Supplement, "Quantum™ Series—Model M 120/277 Exit Signs," Lithonia Emergency Systems, (undated).
Installation Instructions, "QM–EL Emergency Exit Signs," p. 2, Lithonia Emergency Systems (undated).
Brochure, "Dual–Lite EXCITE™ simply beautiful," Dual–Lite, Inc., (Jul. 1980).
Brochure, "Excalibur® Series," Dual–Lite, (facsimile date of Aug. 17, 1987).
Brochure, "Excite™ Series," Dual–Lite, (Mar. 1988).
Brochure, "EZ–Snap™ Series," Dual–Lite, (Sep. 1990).
Brochure, "Single and Dual Lamp Fluorescent AC and Emergency Universal Mounting Exit Signs," pp. 27–28, (undated).
Brochure, "6 Volt Self–Powered Economy Exit Light—Series EP," Elan Lighting Products Division of Altus Corporation (Apr. 1982).
Brochure, "6 Volt Combination Emergency Light/Exit Sign—Series ED," Elan Lighting Products Division of Altus Corporation (Apr. 1982).
Brochure, "Standard and AC–DC Exit Signs—Series WX & BX," Elan Lighting Products Division of Altus Corporation (Sep. 1982).
Brochure, "Chloride . . . the quality innovators—Signout Self–powered AC/DC exit signs," Chloride Systems, (Sep. 1982).
Brochure, "Universal Module Exit Signs—XU Series, AC or AC/DC," Teledyne Big Beam, (Mar. 1989).
Brochure, "Universal Module Exit Signs—XU Series, AC or AC/DC," Teledyne Big Beam, (Aug. 1990).
Brochure, "Dynaray Emergency Lighting—81 Series," Electro Powerpacs Corp. (Jun. 1990).
Brochure, "The New Siltron UX Series—Extruded Aluminum Sealed Maintenance–Free Nickel Cadmium Batteries," Siltron Illumination, Inc. (undated).
Brochure, "Fluorescent Emergency Light Power Pack—CFP Series," Chloride Systems, pp. 11–18, (undated).
Brochure, "Chloride . . . Life Safety Products & Systems—Total Flexibility in a Single Exit Sign," Chloride Systems (undated).
Photographs, Lithonia Lighting Systems Emergency Exit Sign with Arrow Shaped Cover ("Arrow Sign").
Photographs, Lithonia Lighting Systems Emergency Exit Sign with Chevron–shaped Directional Arrows ("Chevron Sign").
Photographs, Model KSR–LED EZ–Snap Series Exit Sign, Dual Lite (Oct. 26, 1994) ("Dual Lite Sign") and Installation Instructions, EZ–Snap LED Exit Signs, Dual–Lite (Jul., 1994).

DIRECTION INDICATOR COVERS FOR EMERGENCY LIGHTING SYSTEMS

The present invention relates to emergency lighting systems provided with directional indicators and to a removable panel for covering such directional indicators.

BACKGROUND OF THE INVENTION

Sound construction and design practice, building codes, regulation and legislation require a number of measures to protect those who work, inhabit and visit buildings and other structures. A primary fire safety improvement required by government and industry regulation, is the use of EXIT signs to indicate egress routes. Among other requirements, exit signs must clearly direct those in flight to the nearest exit during a fire or other emergency.

A simple "EXIT" message can be provided directly above the egress from the building or, where the egress is located away from the optimum position from which the sign can best be viewed, an "EXIT" message is normally coupled with a directional indicator that points toward the exit. Because numerous exit signs may be deployed within a single structure, it is critical that the exit sign and all its components (including the directional indicator) be of low cost, highly durable, and easily installed within the structure.

To accomplish these ends, exit signs have been developed that feature directional indicators or arrows surrounding both sides of the exit sign, with knockouts capable of being removed from the face of the exit sign in order to allow the installer to choose in which direction the exit sign directional indicator should point. For instance, U.S. Pat. No. 3,931,689 to Shine discloses an exit sign with removable arrowheads that have punched or scored portions to allow the installer to select one arrowhead and remove it. Another, almost identical, removable arrowhead surrounded by punch out areas is disclosed by U.S. Pat. No. 5,018,290 to Kozek, et al. However, the scoring about the edges of the arrowhead remaining in place will likely allow significant light to leak through the scoring, possibly to misdirect people away from the location of the exit.

Moreover, while such knockouts make deploying an exit sign easier, they do not allow the arrowheads to be reinserted into the sign in the event that an installer mistakenly removes the wrong arrowhead or the exit sign is redeployed to another area in which the directional indicator points in the wrong direction. Even arrowheads that can be so replaced will often fall behind the face of the exit sign and can only be retrieved with difficulty. For instance, it is known to provide a triangular cover that inserts from behind the exit sign cover and is retained in place by posts positioned about the perimeter of the aperture within the exit sign cover into which a triangular insert is placed. However, pressure upon the front of the triangular insert may cause the posts to release the insert, resulting in its falling into the exit sign. To reinsert the triangular insert requires the exit sign to be removed, and/or its cover taken off and the triangular insert retrieved and replaced, a sometimes laborious and time consuming procedure.

Other exit signs likewise employ covers for directional indicators that may be installed only with laborious procedures. Thus, U.S. Pat. No. 4,355,479 to Thornton discloses an exit sign that allows the installer to select between one of two directional arrowheads by sandwiching an opaque strip between (1) a stencil defining the word "EXIT" and two adjacent arrowhead shaped apertures and (2) a border strip.

Yet properly positioning the opaque strip and then installing the entire assembly is extremely time consuming. Similarly, U.S. Pat. No. 3,665,626 to Lund, et al. discloses a cover with a rectangular hole behind which is a mask having arrowheads pointing in various directions, the mask being adjustable to move a left or right pointing arrowhead into the area directly behind the rectangular hole of the cover to thereby provide a direction indicator. The mask-like means may fail to fill the hole completely, and thus significant light leakage may occur. Furthermore, given the number of exit signs installed in a modern office building, retail store or other significantly sized structure, ease of installation is a necessity in order to minimize labor costs. Neither the Thornton nor Lund, et al. patents disclose devices which admit of easy and quick installation with a minimum of tools. Moreover, once installed, the Thornton and Lund, et al. devices may be jarred or impacted sufficiently to cause the strip or mask to move and display an incorrect directional indication.

Providing covers that tightly secure to directional indicators and maintain a tight, impervious-to-light-leakage or light-fast fit thus remains a significant problem. For instance, in a blazing or smoke obstructed building, the exit sign's direction indicating arrow may be partially obscured and light leaking from the aperture in which an insert is still in place may suggest the wrong direction to the ultimate disadvantage of those who aim to escape. Accordingly, the National Fire Protection Association ("NFPA") has promulgated a "Life Safety Code" (incorporated herein in its entirety by this reference), as of Feb. 11, 1994, which requires that the directional indicator, preferably chevron-shaped, "be identifiable at a minimum distance of 100 ft. (30 m) under all space illumination conditions." To meet these standards, only an extremely minimal level of light leakage about the edges of the cover of a directional indicator is allowed.

The chevron shape required by new regulations, such as those promulgated by the NFPA, provides a larger illuminated surface area than conventional, triangular shaped arrowhead directional indicators. This follows from the fact that for the same height, the chevron shape will cover twice the area as a triangular directional indicator. With the larger illuminated area, the chevron directional indicator is far easier to make out at a distance or in smoke. The downside, primarily for purposes of attachment to the cover, is that the wings of the chevron are long and can thus bend. Accordingly, the chevron, with its larger surface area and greater potential for bending, demands a new approach to being fastened integrally, but easily and tightly, within the cover.

Notwithstanding these requirements and regulations, many conventional replaceable arrowheads simply do not fit sufficiently tightly within their arrowhead shaped apertures so as to preclude light leakage around the edges of the fit between even the conventional arrowhead cover and the arrow aperture. A prime example is the replaceable arrowhead disclosed in U.S. Pat. No. 5,247,756 to Johnstone. Johnstone discloses "a cover [that] is provided with a tongue arranged on its rear surface and projecting from its directional point so as to reside in the stencil notch when . . . inserted. A snap rail is located on the arrow cover edge opposite to its directional point and shaped to mate with the bead of a corresponding edge of the arrow shaped void." The cover is inserted by sliding the tongue into its matching notch and pressing down.

The Johnstone structure aims to provide an arrow which may easily be inserted into the cover from the outside of the sign, but which prevents the worker from inadvertently pushing the cover into the sign and wasting time trying to retrieve it. It does this with the tongue/notch interface on the nose of the arrow. The tongue must first be slid into the notch, thus precluding pushing the arrow into the interior of the fixture, before the back of the arrow is snapped into place. Unfortunately, this "slide 'n' snap" structure precludes a light-fast, secure fit.

Although the Johnstone device purports "to provide a snug fit against the bead and a closed seal to the passage of light when inserted in the stencil void," because the only points of connection are the tongue at the arrow point and the snap rail in the area directly opposite, the fit is not snug around the sides and light accordingly leaks out of the improper fit. Furthermore, the arrow cover is thinner than the exit sign cover to which it is attached and will therefore expand, contract or deform at a different rate than the exit sign cover, which movement creates a loose fit. The loose fit is exacerbated by a pressure pad that prevents the tongue of the arrow cover from resting firmly in its notch and essentially acts as a fulcrum upon which the tongue can oscillate back and forth as the inadequately secured ends of the triangle move within the cover.

These problems would become more pronounced if chevron-shaped directional indicators, which normally each have two long, relatively thin legs, were used rather than the triangular arrowheads disclosed by Johnstone. With chevron-shaped indicators, there is no triangular base to attach to the cover and the legs are therefore more likely to be imperfectly secured and leak light about their edges.

Accordingly, a need arises for a chevron-shaped directional indicator cover that can be fastened firmly into the directional indicator of an exit sign to provide a tight, light-fast fit. Such a cover must continue to maintain the tight, light-fast fit over a long period of time and endure a variety of hostile environmental conditions, including innumerable temperature and humidity excursions, point impacts caused by personnel within the building jostling the exit sign or from maintenance of the exit sign wherein the cover is constantly removed and subject to impact, the inadvertent provision of over powered (and therefore hotter) lamps or even attacks by vandals or a fire. Yet the cover must be installed correctly and competently with a minimum of effort and in minimum time by those who may bring only modest skills and few tools to the task.

SUMMARY OF THE INVENTION

The present invention addresses the above problems by providing a fully light-fast exit sign directional indicator panel that can be detached and replaced from the exit sign front and that is easily assembled and deployed with minimum expenditure of labor and time. The new chevron-shaped panel of the present invention may be easily installed with minimum risk of losing it in the interior of the exit sign fixture during installation; yet the panel surprisingly accomplishes this without the need for a conventional "slide 'n' snap" structure which has proven to be destructive of light-fastness and a tight, secure fit in the past. The panel utilizes uniformly shaped tabs, disposed in a certain manner about the perimeter of the panel, which act to distribute uniformly to the cover the stresses to which the panel is subject. The uniform stress distribution allows even a chevron-shaped panel, with its long wings and greater surface area, to be held in a firm, light-fast fit despite the wear and tear and environmental conditions the exit sign may encounter during its long service.

The present invention includes a housing, in which may be located a lamp (in the form of an incandescent light bulb, LED's or other illumination source), a backup battery and an optional test circuit as well as a plate attached to a wall or ceiling, from which the housing is suspended. Additionally, the housing has at least one removable cover that is stencilled with cutouts forming a message, such as "EXIT," "AUSGANG," or "UTGÄNG," for instance, to either side of which are positioned chevron-shaped apertures capable of accepting the matching, detachable and replaceable chevron-shaped panel. Removal of the panel allows light to illuminate a colored diffuser, captured between the housing and the cover in order to produce both a visually illuminated "EXIT" message and a chevron-shaped aperture pointing toward an egress out of the building.

Positioned about the edge of the panel are several tabs, each of which defines a protrusion, which may have a slanted or rounded edge. The exit sign cover has matching chevron-shaped cutouts or apertures into which the panel may be detachably secured. The apertures and panel may be each provided with complementary partially beveled edges that improve the fit and make the cover and panel intersection more light-fast. Viewed from the posterior of the exit sign cover, grooves or channels may be periodically spaced about the perimeter of the chevron-shaped aperture. These channels are adapted to accept the panel's tabs. From a cross sectional perspective of the channel and tab, the channels allow a triangular tip formed by the intersection of the bevel and channel to be seated in the junction between the bevel and a protrusion extending from each tab. To cover the aperture, the panel is inserted into the cover so that the respective bevels of the panel and the aperture engage firmly and the tabs, located on one edge of the panel, may engage the channels. The other, second edge of the panel will then have tabs resting adjacent corresponding channels. Applying firm pressure across the second edge of the panel to be inserted in the cover pops the tabs into the corresponding channels. Optionally, the channels may be omitted and the tabs may simply extend from a beveled edge to the posterior of the panel in order to define a junction in which the edges of the aperture may be secured.

The panel is thus held firmly in place via the engagement between the snap locking tabs and the aperture edges, as well as the tight fit and matching bevels between the panel and the aperture. The tight fit between the panel and the aperture ensures that the exit sign of the present invention will not allow light leakage to distract those relying on the exit sign for direction. Moreover, the tight fit ensures that the panel will not pop out of the exit sign when the cover is removed to service the emergency lighting system, which periodically occurs when lamps or the rechargeable battery are replaced, or the exit sign is otherwise serviced.

Because the interlocking tabs and edges that hold the panel of the present invention within the exit sign are distributed about the perimeter of the panel, the forces holding the panel within the exit sign are fairly uniformly distributed about the perimeter of the panel, which thereby better maintains its position even when substantial force impacts the panel in discreet areas. For example, supporting each of the two wings of the chevron-shaped panel in at least two of the quadrants surrounding the centroid of each wing allows each wing to maintain its engagement in the cover even if the other wing pops out of place. Indeed, because of the multiple retention axes formed between the tabs surrounding each wing, even if one of the tabs for a single wing releases or is improperly secured, the other tabs will retain that wing in place. Moreover, if one tab pops out, the flexion of the panel biases the tab against the cover bevel. This flexion causes forces to be applied to the other tabs so that they bear even more urgently against the edges of the aperture. This flexion also causes a bending moment to be applied between the other tabs in the wing which torques them against the aperture edges to cause the panel to be held in place securely.

The panel is removable only by pressing on the back of the panel, thus decreasing the chance that the panel may fall into the surrounding structure when the cover absorbs some impact on its front. Furthermore, even if a panel falls into the exit sign housing or is dropped to the floor by an installer, the panels can be interchanged as desired since they are removable, replaceable and interchangeable.

Given the long service life of exit signs, which frequently need to last the life of the structure, it is necessary that the directional indicator of the exit sign be temperature and humidity stable. Otherwise, the directional indicator may deform and either allow light leakage or simply loosen and become susceptible to being accidently knocked out. Although any one of numerous materials, including polycarbonate or "Noryl" (available from General Electric Company), may be used to provide a stable product, it has been found that polycarbonate ABS is an excellent material. Apart from excellent mold flow and forming characteristics and UV resistance specifications, polycarbonate ABS is flexible enough for the snap-locking tabs of the present invention to engage the aperture effectively. It is additionally a stable material that will rarely deform under the numerous temperature and humidity excursions that an exit sign is subject to during its long service life or in a fire. Polycarbonate ABS also is a material that meets the rigorous UL (Underwriter's Laboratories) standards for thermoplastic products in exit signs.

Creating the desired tight fit between the panel and the aperture requires that the panel be of dimensions substantially the same as the aperture. Although such high tolerances normally render the resulting product expensive and difficult to manufacture or install, one efficient manufacturing method is to create an appropriate mold for the panel and insert an appropriate material, such as polycarbonate ABS into the mold. Once the material cures, a slide pulls away from the trailing edge of the panel and ejector pins extract the finished panel from the mold. By providing a chamfer on the tabs located at the trailing edge of the panel, the slide is better able to withdraw from the panel without causing deformation in the back tabs. The present invention accordingly enhances reliable, inexpensive and efficient manufacture.

It is therefore an object of the present invention to provide an economical and easily formed exit sign with directional indicators that can be easily covered.

It is also an object of the present invention to provide a panel for fitting over new, chevron-shaped directional indicators.

It is another object of the present invention to cover a directional indicator with a panel that can be efficiently detached and reinserted from outside the exit sign, on the front of the cover, into the directional indicator and thereby reduce installation time.

It is yet another object of the present invention to provide a panel for a chevron-shaped directional indicator that when placed within the exit sign prevents light from leaking about the edges of the panel and tightly engages the directional indicator.

It is an additional object of the present invention to provide a panel with two wings in which each wing is independently fixed to the directional indicator so that one of the wings remains in place even when the other wing releases.

It is another object of the present invention to provide a panel with two wings for a chevron-shaped directional indicator wherein the panel has several axes of retention so that the panel is held firmly in place even when one or more of the retention axes fails.

It is an additional object of the present invention to provide a panel which may be installed without tools, and which provides multiply redundant means of retention to the cover.

It is a further object of the present invention to provide a panel that distributes stresses uniformly about the edges of the panel.

It is yet a further object of the present invention to provide a panel formed from a material that is resistant to deformation caused by temperature, humidity, impact forces or other environmental conditions, and that maintains over long periods of time its tight and light-fast fit with the exit sign.

Other objects, features, and advantages of the present invention will become apparent with respect to the remainder of this document.

DETAILED DESCRIPTION OF THE DRAWINGS

Figure 1:
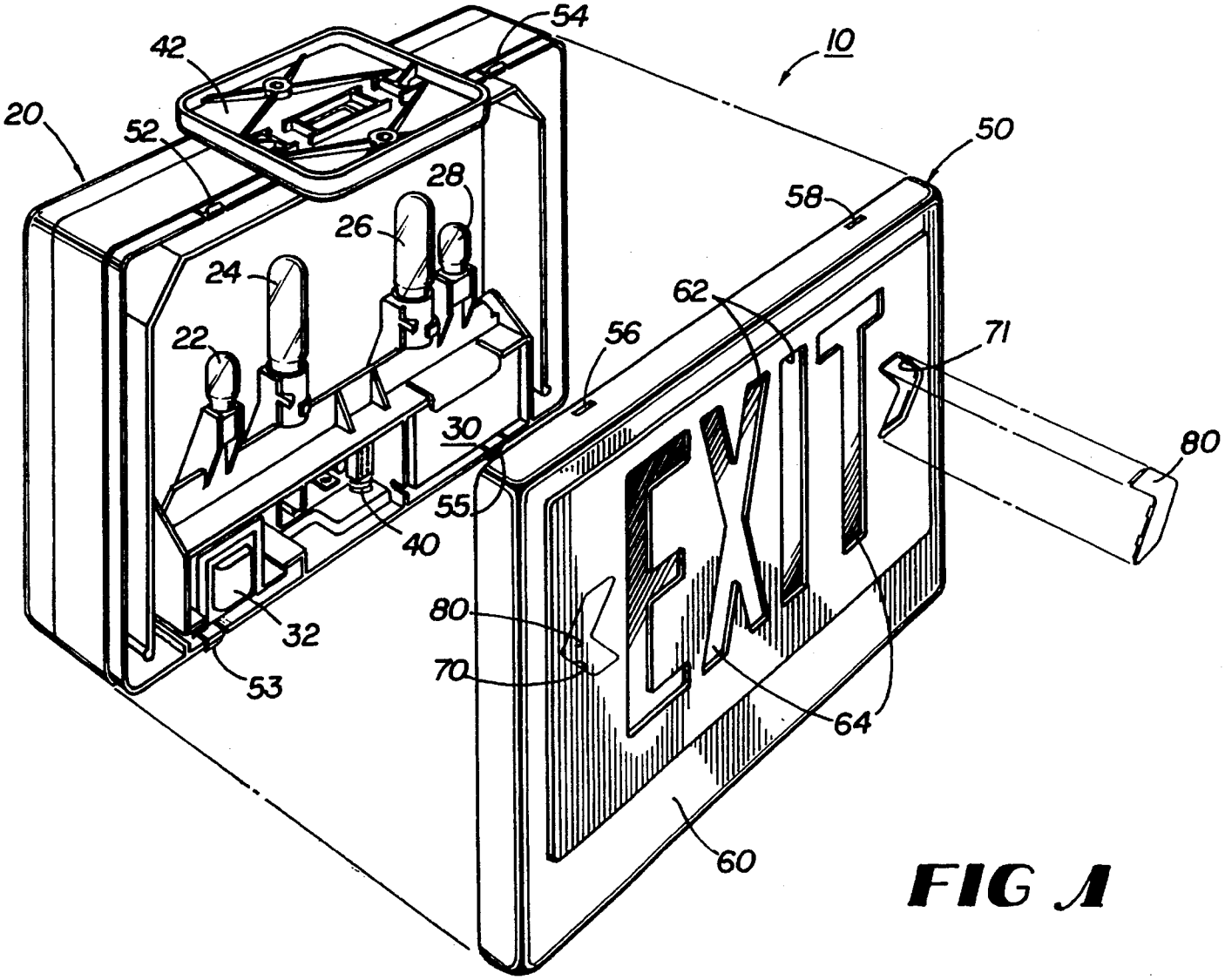
FIG. 1 is an exploded perspective view of the preferred embodiment of an exit sign according to the present invention.

FIG. 1 illustrates the exit sign 10 of the present invention. Exit sign 10 has a housing 20 in which is located several lamps 22, 24, 26 and 28, placed in a dispersed pattern so as to distribute uniformly the light within the housing 20, as well as to limit the heat concentration within any one part of the housing 20. Lamps 22, 24, 26 and 28 are supplied with power by either the building power source or a battery 30, which can be recharged. Thus, the building power source can provide power for the lamps 22, 24, 26 and 28 during normal operation of the exit sign 10 and, during an emergency, the battery 30 will provide backup power. Alternatively, the exit sign 10 could be connected to an auxiliary generator that supplies power to the exit sign 10 in the event of a main power failure.

Within the housing 20 is a transformer 32 that may be used to step down the building supply voltage in order to recharge the battery 30. Also shown in the housing 20 is a circuit testing means 40 for ascertaining whether the battery 30 is properly charged. Detachably connected to the top of the housing 20 may be a plate 42 through which fastening means can be passed in order to secure the plate 42 to a structure, such as a wall or ceiling, for supporting the housing 20. Housing 20 also has a cover 50 which may detachably connect to the housing 20 via flexible tongues 52, 54 that flex to insert into and interlock with respective matching apertures 56, 58 located on the cover 50. Similarly, flexible tongues 53, 55 insert into matching apertures disposed about the bottom of the cover 50.

The face 60 of the cover 50 has stencilling 62 that defines a message, such as the word "EXIT." Clearly, the stencilling 62 could define other messages or an equivalent word in another language. Also defined by the cover 50 are two chevron-shaped apertures 70 and 71. The left aperture 70 is provided with a baseplate or panel 80 and the right aperture 71 remains open in order to provide a directional indication. Panel 80 may be formed in the shape of a chevron and defines an anterior 79, a posterior 81, a trailing edge 83 and a leading edge 85. Alternatively, the apertures 70, 71 and panels 80 could be formed in the shape of a triangle, arrowhead or any other readily recognizable directional indicator.

Panel 80 is inserted from the front of the cover 50, thereby eliminating the danger that the panel 80 will fall into housing 20 and cause the installer laboriously to remove the cover 50 from the housing 20 in order to retrieve the panel 80. Panel 80 is substantially the same size as both chevron-shaped apertures 70, 71 in order to form a very tight fit once inserted. Further, the panel 80, cover 50 and housing 20 can each be formed of a plastic material that is hard and durable yet sufficiently resilient to further improve the fit between the panel 80 and the cover 50. One excellent material for forming the panel 80, cover 50 and housing 20 is polycarbonate ABS. The flexible nature of the material from which the components of the exit sign 10 are formed allows the panel 80 to be removed by pressing firmly upon the back side of the panel 80 to force its tabs 88 out of engagement with matching grooves 74.

Behind the cover 50 is a translucent diffuser 64 that normally is tinted red, but which can be any other of numerous colors. Once the cover 50 is placed over the housing 20, and the lamps 22, 24, 26 and 28 are activated by the emergency backup battery 30 (or other power source), light will pass through the stencilling 62, be filtered by diffuser 64 and thus define a glowing "EXIT" message with the open chevron-shaped aperture 71 pointing toward the right of the exit sign 10. However, because the panel 80 is shaped to fit tightly into the chevron-shaped left aperture 70, no light escapes from the edges of the panel 80 in order to distract or dangerously misdirect persons relying on the exit sign 10 in an emergency or who may merely hastily glance at the exit sign 10. Moreover, because of the tight fit, in the event of a fire or a drastic increase in heat, the panel 80 remaining within the aperture 70 will fuse or at least remain integral with the cover 50 rather than deforming and possibly falling out of place or allowing light leakage when the need for an accurate directional indicator is most critical.

The chevron shape of the panel 80 is in accordance with recent regulations and safety design requirements, such as the NFPA/ANSI 101 "Life Safety Code," § 510 (Feb. 11, 1994), entitled "Marking of Means of Egress." These aim to provide a larger lit surface area with the same height and width dimensions, or similar such dimensions, presently occupied by conventional arrowhead shaped directional indicators. The benefits offered by a chevron-shaped directional indicator are that it is far easier to make out at a distance or in smoke because its components, which point either left or right, are in the form of wings, which have breadth and thus permit more light transmission than the conventional, arrowhead shaped directional indicators. The downside, primarily for purposes of attachment to the cover 50, is that the wings of a chevron-shaped directional indicator cover are long and can thus bend. Accordingly, a chevron-shaped directional indicator cover, with its larger surface area and greater potential for bending, demands new approaches to being fastened integrally, but easily and tightly, within the cover 50.

Figure 2:
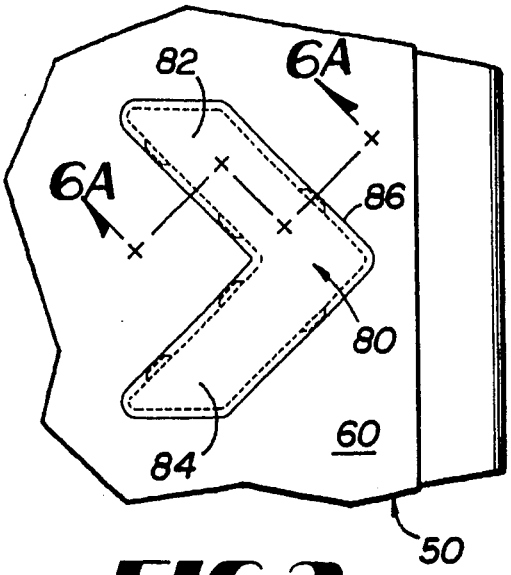
FIG. 2 is an anterior, cut-away detail view of the exit sign cover shown in FIG. 1 provided with a panel inserted into the chevron-shaped aperture.
Figure 3:
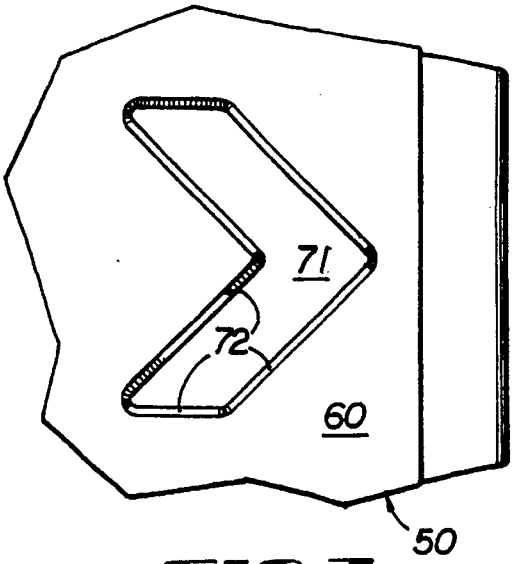
FIG. 3 is an anterior, cut-away detail view of the cover shown in FIG. 2 without the panel in place.
Figure 4:
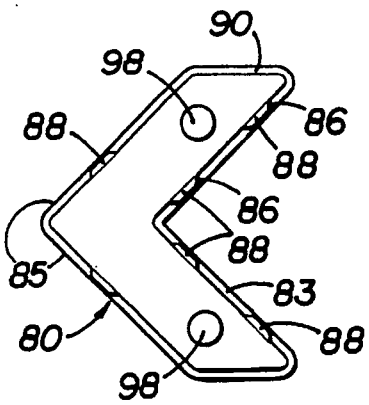
FIG. 4 is a posterior view of the panel for placement in the cover shown in FIG. 1.
Figure 5:
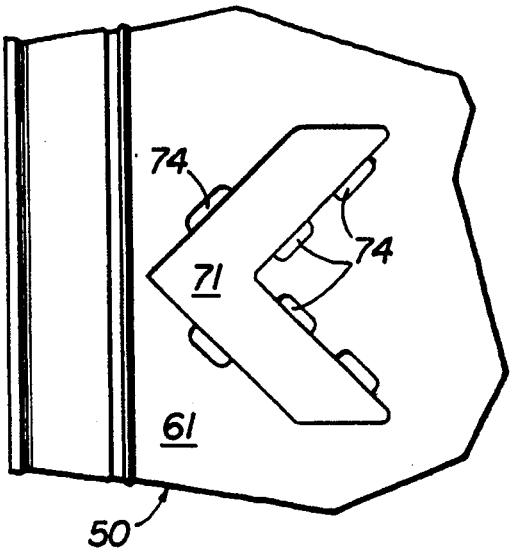
FIG. 5 is a posterior, cut-away view of the cover shown in FIG. 1, without the panel in place.

FIGS. 2–6 show details of the construction of the cover 50 and panel 80, which may define a first wing 82, a second wing 84, a number of tabs 88 and a beveled edge 90. Both the first and second wings 82, 84 may be parallelograms joined along their shorter legs, at a central axis, in order to create a chevron-shaped panel 80 that is substantially the same size as chevron-shaped aperture 71 of the cover 50. As seen in FIG. 2, when the panel 80 is attached to the cover 50, virtually no light will be able to escape about the top edges 86 of the panel 80. Partially, the tight fit between the panel 80 and the chevron-shaped aperture 71 is the result of the aperture bevel 72, which may surround the perimeter of the aperture 71 either entirely as seen in FIG. 3 or partially. Aperture bevel 72 engages firmly with a matching panel bevel 90 that surrounds the panel 80, and that may slant from the anterior 79 to the posterior 81.

Figure 6A:
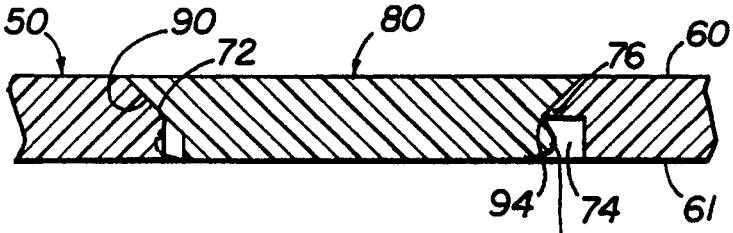
FIG. 6A is a cut-away cross-sectional view taken along lines 6A—6A of the panel snap-fitted into place in the cover shown in FIG. 1.
Figure 6B:
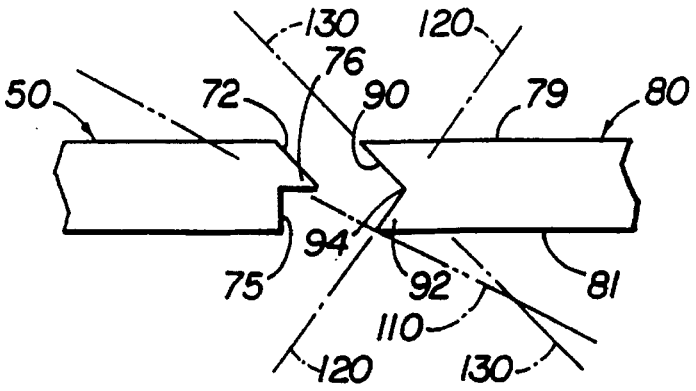
FIG. 6B is a cut-away, exploded schematic view of a first alternative embodiment of the means for securing the panel and cover.
Figure 6C:
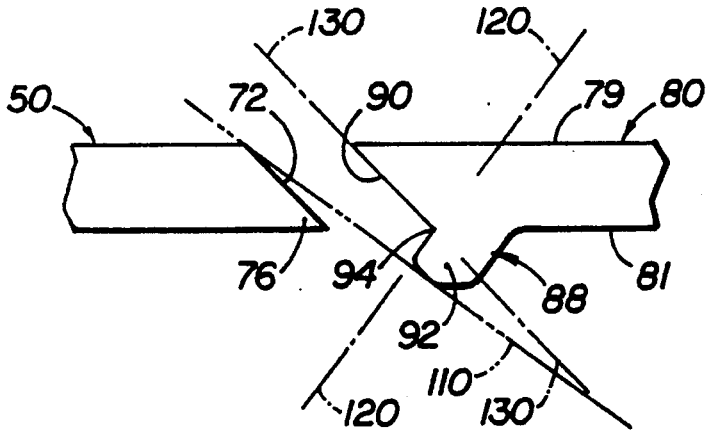
FIG. 6C is a cut-away, exploded schematic view of a second alternative embodiment of the means for securing the panel and cover.

Several of the tabs 88 are disposed about the perimeter of each of the first and second wings 82 and 84. The tabs 88 fit into matching grooves 74 that are positioned to receive each tab 88 or they may simply engage an edge of the aperture 70. FIGS. 6A–C illustrate each tab 88 with a protrusion 92 that may be rounded or slanted to define an engagement plane 110. The intersection of a protrusion 92 with the panel bevel 90 forms a groove or junction 94, which defines a capture edge plane 120. An oblique angle whose vertex is located at junction 94 separates the capture edge plane 120 from the panel bevel plane 130.

In the embodiments illustrated by FIGS. 6A and 6B, the panel 80 has only a partial panel bevel 90, which slants from the anterior 79 of the panel 80 to its posterior 81. At the end of the panel bevel 90, a wall 75 may connect the panel bevel 90 to the posterior 81. Although the wall 75 is shown oriented substantially perpendicular to the anterior 79, it may alternatively be slanted or angled with respect to the anterior 79. Cover 50 forms several pointed ends or points 76 that may, as the panel 80 is inserted into the aperture 70, flex toward the posterior 81 of the panel 80 and thereby slide over the protrusion 92. Points 76 thus seat firmly within the junctions 94 and may then be held between the capture edge plane 120 and the panel bevel plane 130 in order to provide a tight, snap locking fit between the panel 80 and the edges 76 of the cover 50. Protrusion 92 may then rest within the space provided by the groove 74.

FIG. 6C shows an alternative embodiment of the panel 80 and cover 50, which does not have the matching grooves 74 into which the tabs 88 may secure. Instead, the cover 50 may be given a full aperture bevel 72 that ends in a point 76.

Likewise, the panel 80 in FIG. 6C may be given a complete panel bevel 90 that matches to the complete aperture bevel 72. Tabs 88 may then each extend from the posterior 81 of the panel 80 and define a junction 94 between the tabs 88 and the panel bevel 90. Panel 80 is inserted by applying pressure directed from the anterior 79 toward the posterior 81, which causes the tabs 88 to force points 76, defined by the aperture bevel 72 of the cover 50, downward and across the engagement plane 110 of the protrusion 92. As the points 76 flex, the panel 80, even though sized substantially the same as the chevron-shaped aperture 70, is able to slide into a tight fit with the aperture 70. Once the panel bevel 90 and aperture bevel 72 are fully engaged, the points 76 are captured by the junction 94 and the capturing plane 120. Panel 80 shown in FIG. 6C may preferably be maintained the same width as the cover 50 so that the cover 50 and the panel 80 may expand and contract at the same rate and thereby prevent the light-fast and tight fit between the panel 80 and the cover 50 from being compromised.

Figure 7A:
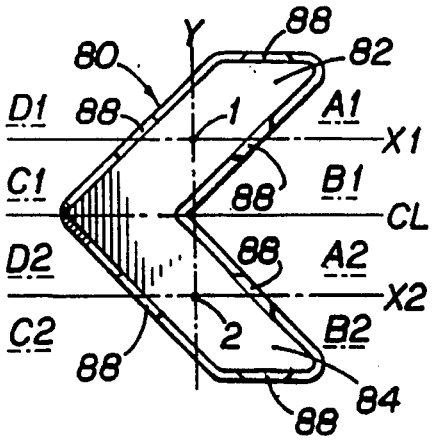
FIGS. 7A–B are posterior views of an alternative embodiment of the panel of the present invention showing the centroids of each wing of the panel.

FIG. 7A shows centroids 1, 2 of each of the first and second wings 82, 84, respectively, which correspond to the first and second wings' 82, 84 centers of gravity. The centroids 1, 2 correspond to the principal bending axes of each of the first and second wings 82, 84; for instance, if vertical forces are applied toward each other at the centerline of the panel 80 and the top edge of the first wing 82, maximum bending of the first wing 82 will center along axis X1. It accordingly becomes important to disperse attachment of the first wing 82 to the cover 50 in various quadrants about centroid 1, in order to prevent the first wing's 82 deformation.

Figure 7B:
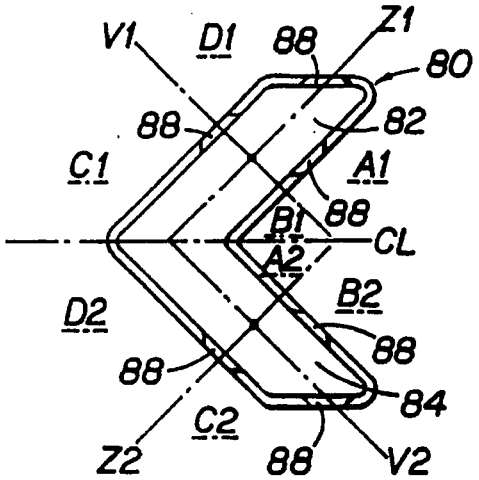

For purposes of reference, passing through both centroids 1 and 2 is a "Y" axis; the "X1" and "X2" axes pass through centroids 1 and 2 respectively to intersect with their common Y axis. Together the X1 and Y axes define four quadrants, A1, B1, C1 and D1 located about centroid 1. Similarly, the X2 and Y axes also define four quadrants A2, B2, C2 and D2 located about centroid 2. (As shown by the V1, Z1 and V2, Z2 axes of FIG. 7B, the axes' orientation need not be vertical and horizontal and the quadrants likewise need not be so oriented). For each of first and second wing 82, 84, so long as at least two tabs 88 are located in two non-adjacent quadrants surrounding the centroid of either first wing 82 or second wing 84, each of the first and second wings 82, 84 is separately resistant to point impacts that may otherwise cause the panel 80 to pop out or fall from the cover 50. This is particularly important where the panel 80 is in the shape of a chevron since a chevron covers more area than a conventional, triangular arrowhead of the same dimensions. Since the periphery of the chevron-shaped panel 80 is farther from its center of gravity than is the periphery of a triangular arrowhead, at least two of the quadrants (preferably, non-adjacent, such as quadrants A1 and C1 or B2 and D2) surrounding the centroid of each of the first and second wings 82, 84 should have a tab 88 located at least partially within the quadrants to ensure a proper fit even under significant point forces. Such an arrangement is shown in FIGS. 7A–B, which illustrates at least two tabs 88 that are located within at least two non-adjacent quadrants surrounding the centroid 1; likewise, at least two other tabs 88 are located within at least two nonadjacent quadrants surrounding the centroid 2.

Panel bevel 90 formed in the panel 80 and the aperture bevel 72 formed in the chevron-shaped apertures 70, 71 may each be cut at a 45° angle. Apertures 70, 71 could be provided with other than matching 45° angled bevels (e.g., panel 80 could have a 30° bevel and the apertures 70, 71 could have a 70° bevel). Greater or lesser angular separation optionally could divide the first and second wings 82, 84 of the panel 80, as shown by FIG. 10, which illustrates an alternative embodiment of panel 80 that has the wings of a panel 80 joined at an oblique angle. Although the first and second wings 82, 84 are best supported tightly within the cover 50 when the tabs 88 fall within at least two non-adjacent quadrants surrounding the centroid of the panel 80, as shown in FIGS. 7–10, panel 80 could be provided with alternative arrangements and numbers of tabs 88 surrounding the perimeter of the panel 80.

Figure 8:
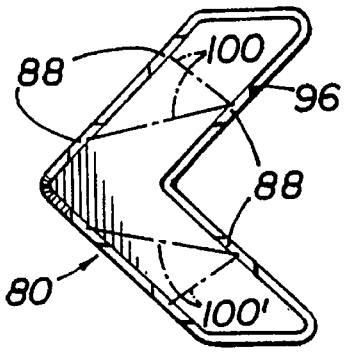
FIGS. 8–10 are posterior views of alternative embodiments of the panel of the present invention.
Figure 9:
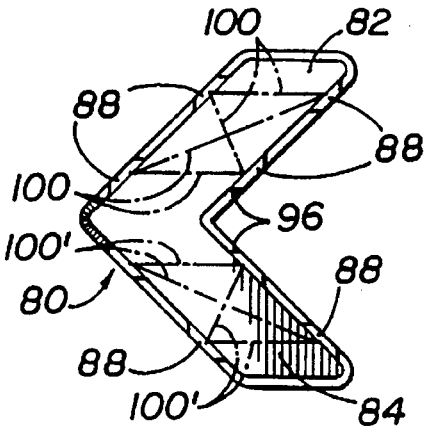
Figure 10:
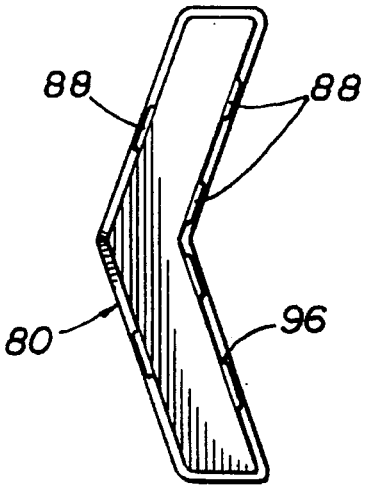

As shown in FIGS. 8 and 9, however, providing at least three tabs 88 on each wing forms multiple retention axes 100. Each retention axis 100, which generally pass between the midpoints of the tabs 88, acts to hold the panel 80 in place. If, for instance, in the panel 80 shown in FIG. 9, one of the retention axes holding the first wing 82 in place were to fail because a tab 88 was incorrectly inserted or released from engagement with the cover 50, the other retention axes of the first wing 82 would still maintain it and the panel 80 in a tight and light-fast fit. Moreover, even if all of the retention axes 100 of the first wing 82 failed, the multiple retention axes 100 of the second wing 84 would still maintain the panel 80 in its position within the cover 50. Thus, the multiple retention axes 100 may act to spread the stresses to which the panel 80 is subject and provide auxiliary support while the panel 80 is located within the cover 50 and possibly being impacted by various point stresses or simply enduring the environmental conditions the exit sign 10 is subject to over its long service life.

Figure 7C:
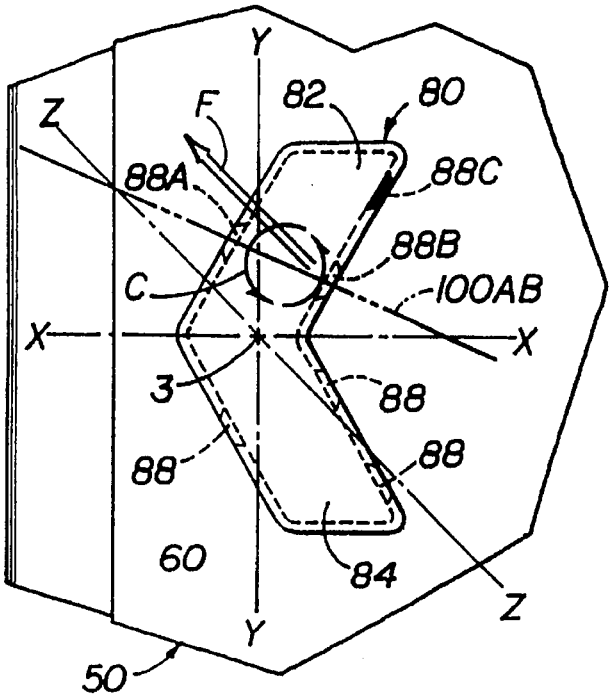
FIG. 7C is an anterior view of an alternative embodiment of the panel of the present invention in which one tab is dislodged from the cover.

FIG. 7C illustrates a panel 80 with a horizontal X axis, vertical Y axis and Z axis directed into the centroid C of the panel 80. If, as shown in FIG. 7C, one tab 88C releases, the first wing 82 is still retained within the cover 50 because the other tabs 88A, 88B will distribute the resulting forces to the cover 50. Although the release of tab 88C destroys one of the multiple retention axes 100 (i.e., the axis normally located between tabs 88A and 88C) securing the first wing 82 to the cover 50, the retention axis 100AB remains and operates to maintain the first wing 82 within the cover 50 even though the tab 88C is no longer secured to the cover 50.

As shown in FIG. 7C, dislodging of the tab 88C from the aperture causes the panel 80 to flex and bias the tab 88C against the aperture bevel 72. This creates both a vertical and a horizontal force on the panel 80. The horizontal force is directed against the edge of tab 88C and creates a couple C about the centroid 3 of the first wing 82. Couple C causes the protrusions 92 of their respective tabs 88A and 88B to bear more tightly against the pointed edges 76 to which they secure. Thus, the couple C actually causes forces that hold the first wing 82 (and thus the panel 80) in place even more firmly. Moreover, the vertical force created as the panel 80 flexes to bias the tab 88C the aperture bevel 72, torques the tabs 88A and 88B that remain secured to the cover 50 farther against the pointed edges 76 held by their respective protrusions 92. For instance, the dislodgement of tab 88C flexes the panel 80, which flexion is opposed by a force F, located at tab 88B and directed from the anterior 81 to the posterior 79 of the panel 80 (i.e. parallel to the Z axis shown in FIG. 7C). Force F causes the junction 94 defined by the capture edge plane 120 and the bevel plane 130 to bear even more firmly against the pointed edge 76 captured by tab 88B (yet not so firmly as to allow the tab 88B to release). Similar forces created by the flexion of the panel 80 bias tabs 88 located on second wing 84 more forcefully against the points 76 that their respective junctions 74 capture and thus hold the panel 80 firmly into place.

In forming any of the alternative embodiments of the panel 80 or cover 50, because of the structure of the panel 80, it is difficult to remove the panel 80 from any mold that may be used to form some plastics material, such as polycarbonate ABS, into the panel 80. Thus, tabs 88 may optionally be provided with chamfers 96, which may have at least one edge running substantially parallel to the central axis defined by the junction of the first and second wings 82, 84. These chamfers 96, particularly those on the tabs 88 located on the trailing edge 83 of the panel 80, allow the slide that forms the back portion of a mold, in which is held the material that cures into the panel 80, to be extracted from the trailing edge 83 of the panel 80 in a horizontally backward movement without causing deformation of the tabs 88. Following the retraction of the slide, ejector pins corresponding, for instance, to circles 98 upon each of the first and second wings 82, 84 eject the panel 80 from the mold. In this manner, the complex structure of the panel 80 can be formed cost effectively in order to create the exit sign 10 at the lowest possible cost and with great dimensional stability.

The foregoing is provided for purposes of illustrating, explaining and describing preferred embodiments of the present invention. Modifications and adaptations to the described embodiments will be apparent to those of ordinary skill in the art and may be made without departing from the scope or spirit of the invention and the following claims.

What is claimed is:

1. An illuminated exit sign for providing guidance to the egress of a building, the exit sign comprising:

a. a housing;

b. at least one lamp within the housing;

c. a cover removably attached to the housing and which defines a front surface facing outwardly from the sign and a reverse surface and comprising:

i. means for forming a message;

ii. a plurality of chevron-shaped apertures, each having a perimeter, at least two of which are located on the front surface of the cover and adjacent the message, each of which comprises:

(a) a first and second section that join to form a chevron shape; and (b) when viewed in cross section, an aperture bevel extending from the front surface at least partially to the reverse surface to form an edge for capturing portions of an insert; and d. a detachable insert, for covering one of the chevron-shaped apertures, comprising:

i. a chevron-shaped baseplate, sized substantially the same as at least one of the chevron-shaped apertures, containing an anterior surface and a posterior surface and featuring two wings, each of which has a centroid and a leading edge and a trailing edge;

ii. a bevel, extending at least partially from the anterior surface to the posterior surface of the baseplate and surrounding the baseplate and corresponding in orientation to the aperture bevel; and iii. for each wing, at least three identical tabs dispersed about each wing, each of which when viewed in cross section alike extend from the bevel to a protrusion, and then back to the posterior side of the baseplate, thus forming a groove in which the edge of the aperture may be captured in a manner to allow the tabs securing the wing to the cover to occupy at least two non-adjacent quadrants about the centroid of each wing, the tabs forming a plurality of retention axes, each retention axis extending between a portion of one tab and a portion of another tab, the tabs thereby adapted to resist removal of the insert from the cover.

2. An exit sign according to claim 1 in which the first section, second section and both wings are each formed in the shape of a parallelogram.

3. An exit sign according to claim 1 in which the wings have two reference axes defining quadrants about the centroid, in which the wings are jointed at a central axis and at least one reference axis is parallel to the central axis.

4. An exit sign according to claim 3 in which the tabs located on the trailing edge are provided with chamfers having at least one edge parallel to the central axis.

5. An exit sign according to claim 1 in which the protrusion is rounded and defines an engagement surface that assists the edges of the aperture to flex and move over the protrusion before being captured in the groove.

6. An exit sign according to claim 1 in which the protrusion defines a capture plane and the bevel defines a bevel plane, each of which are separated by an oblique angle.

7. An exit sign according to claim 1 in which the protrusion defines a slanted engaging surface that assists in the insertion of the insert into the aperture without deformation of the tabs.

8. An exit sign according to claim 1 in which the protrusion defines a rounded engaging surface that assists in the insertion of the insert into the aperture without deformation of the tabs.

9. An exit sign according to claim 1 in which the cover further comprises a plurality of channels, which are located on the reverse surface of the cover and are adjacent the chevron-shaped apertures.

10. An exit sign according to claim 9 in which the channels receive the tabs.

11. An exit sign according to claim 9 in which a bevel surrounds the perimeter of the chevron-shaped aperture and is formed to match the panel bevel to provide an improved fit.

12. An exit sign according to claim 11 in which each channel and the bevel together define a capture edge for insertion within the groove.

13. A removable insert for covering a generally chevron-shaped direction indication means illuminated with light generated within a housing, the insert comprising:

a. an anterior surface;

b. a posterior surface;

c. a first wing defining a first edge;

d. a second wing defining a second edge;

e. wherein the first wing and the second wing are joined at the first edge and second edge to form a chevron shape; and f. wherein each of the first and second wings have a centroid and four quadrants surrounding the centroid;

g. a bevel, encircling the insert and slanting inwardly from the anterior toward the posterior of the insert;

h. means for detachably securing the insert to the direction indication means in order to allow the insert to be removed from or reinserted into the directional indication means without impairing the tight, light-fast fit provided by the securing means, which comprises:

i. three identical tabs, arising from the bevel, wherein each tab when viewed in cross section defines a protrusion with an engagement edge and a capture edge for holding the insert in the tight, light-fast fit with the direction indication means;

ii. in which the tabs are positioned so as to surround each of the first and second wings such that the tabs are located in at least two non-adjacent quadrants, the tabs forming a plurality of retention axes, each retention axis extending between a portion of one tab and a portion of another tab, the tabs thereby adapted to resist removal of the insert from the cover; and, i. wherein the insert is sized to fit closely within the direction indication means.

14. The removable insert according to claim 13 in which each of the first and second wings are formed in the shape of a parallelogram.

15. The removable insert according to claim 13 in which the bevel slants partially from the anterior to the posterior of the insert and then forms a wall oriented substantially perpendicular to the anterior surface of the panel.

16. The removable insert according to claim 13 in which each tab inserts into a corresponding channel, a plurality of which are located on the direction indication means.

17. A lighting system comprising:

a. a housing;

b. means, located within the housing, for generating light;

c. a cover, comprising:

i. a face surface;

ii. a back surface;

iii. a plurality of chevron-shaped apertures for providing a directional indication, each aperture comprising:

(a) a first parallelogram;

(b) a second parallelogram; and (c) a first axis formed by the junction of the first and second parallelograms; and iv. a bevel, extending from the face surface to the back surface and at least partially surrounding each of the apertures, wherein the bevel assists in forming a plurality of capture edges;

d. a panel substantially the same size as the aperture for removably attaching to the aperture, wherein the panel defines an anterior surface, a posterior surface, a first wing and a second wing, wherein each of the first and second wings are parallelograms having a periphery and are joined together to form a chevron;

e. a bevel, surrounding the panel and extending at least partially through the panel;

f. for each of the first and second wings, at least three identical tabs located on the periphery of the wing, each tab comprising:

i. a protrusion; and ii. a capture surface for receiving and securing one of said capture edges in order to hold the panel to the aperture in a tight, light-fast fit; and g. each tab, when considered with each other tab, defining a retention axis, so that each wing contains at least two retention axes in order to allow remaining tabs on remaining retention axes to continue to secure the wing in place in the event that a tab is dislodged, and in a manner that distributes stresses from the panel to the cover.

18. A lighting system according to claim 17 in which the tabs are substantially the same size.

19. A lighting system according to claim 17 in which each wing defines a centroid and the retention axes do not pass through the centroid.

20. A lighting system according to claim 19 in which for each wing the tabs are located in at least two non-adjacent quadrants surrounding each centroid.

21. A lighting system according to claim 17 in which each wing defines a trailing edge and the tabs located on the trailing edges comprise a chamfer.

22. An emergency lighting system for indicating a direction to an exit under a variety of lighting conditions, the system comprising:

a. a housing for enclosing a means for generating illumination;

b. a removable cover, attached to the housing, having a face, a back and stenciling for defining a message;

c. a diffuser, secured between the removable cover and the housing, capable of allowing light to pass through the diffuser in order to illuminate the message;

d. a plurality of chevron-shaped apertures, each having a perimeter, formed within the cover and located adjacent the message for indicating a direction when light travels through the diffuser and escapes through the aperture, at least one aperture comprising:

i. a first parallelogram and a second parallelogram, joined at a central axis to form the chevron-shaped aperture;

ii. a bevel partially slanting from the front of the cover toward the back of the cover and surrounding the perimeter of the aperture; and iii. a substantially vertical wall connected to the bevel and the back of the cover;

e. a series of channels inscribed in the back of the cover and surrounding the perimeter of the chevron-shaped aperture, each channel combining with the bevel to form a capture point;

f. a removable and replaceable panel, defining an anterior surface, a posterior surface, a leading edge and a trailing edge, shaped to fit tightly within the aperture, the panel comprising:

i. a first wing and a second wing, each formed into a parallelogram, joined at a central axis to form a chevron shape and having a centroid;

ii. for each of the first and second wings, four quadrants surrounding the centroid;

iii. a panel bevel surrounding the panel and slanting at least partially inwards from the anterior surface to the posterior surface;

iv. for each of the first and second wings, at least three tabs, located on the leading and trailing edges of the panel in at least two non-adjacent quadrants so as to provide multiple retention axes, each tab shaped substantially the same and when viewed in cross section comprises:

(a) a protrusion joined to the panel bevel and the posterior of the panel, wherein the protrusion defines (b) a rounded engaging surface over which a capture point of the aperture will slide; and (c) a capturing surface for engaging the capture point of the aperture in order to secure releasably the capture point of the aperture and thereby provide a tight, light-fast fit between the panel and the aperture; and g. wherein the tabs located on the trailing edge of the panel define a chamber having at least one edge parallel to the central axis of the panel.

* * * * *

UNITED STATES PATENT AND TRADEMARK OFFICE

CERTIFICATE OF CORRECTION

PATENT NO. : 5,611,163
DATED : March 18, 1997
INVENTOR(S) : Stephen T. Smith

It is certified that error appears in the above-indentified patent and that said Letters Patent is hereby corrected as shown below:

Column 14, line 46, claim 22, insert --identical-- after three

Signed and Sealed this

Fourteenth Day of April, 1998

Bruce Lehman

*Attest:*

BRUCE LEHMAN

*Attesting Officer*

*Commissioner of Patents and Trademarks*